US009937606B2

(12) United States Patent
Hampel et al.

(10) Patent No.: US 9,937,606 B2
(45) Date of Patent: Apr. 10, 2018

(54) POWER SCREWDRIVER AND/OR DRILL

(71) Applicant: Robert Bosch GmbH, Stuttgart (DE)

(72) Inventors: Thomas Hampel, Magstadt (DE); Juergen Gairing, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 633 days.

(21) Appl. No.: 14/075,274

(22) Filed: Nov. 8, 2013

(65) Prior Publication Data

US 2014/0131060 A1 May 15, 2014

(30) Foreign Application Priority Data

Nov. 9, 2012 (DE) ..... 10 2012 220 426

(51) Int. Cl.
*B25B 21/00* (2006.01)
*B25F 5/02* (2006.01)

(52) U.S. Cl.
CPC ..... *B25B 21/00* (2013.01); *B25F 5/02* (2013.01)

(58) Field of Classification Search
CPC ..... B25B 21/00; B25B 13/00; B25B 15/00; B25F 5/02
USPC ..... 173/170, 171, 217
See application file for complete search history.

(56) References Cited

U.S. PATENT DOCUMENTS

2003/0070511 A1* 4/2003 Nottingham ..... B25B 21/00 81/54
2006/0192527 A1* 8/2006 Kageler ..... B25F 5/00 320/115
2007/0256914 A1* 11/2007 Lohr ..... B25B 21/00 200/5 A

FOREIGN PATENT DOCUMENTS

| | | | |
|---|---|---|---|
| CN | 1596170 | A | 3/2005 |
| CN | 101010172 | A | 8/2007 |
| CN | 101811297 | A | 8/2010 |
| DE | 36 23 636 | A1 | 1/1988 |
| DE | 197 35 506 | A1 | 11/1998 |
| DE | 20 2006 017 683 | U1 | 5/2008 |
| JP | 2002-8489 | A | 1/2002 |

* cited by examiner

*Primary Examiner* — Robert Long
*Assistant Examiner* — Xavier A Madison
(74) *Attorney, Agent, or Firm* — Maginot, Moore & Beck LLP

(57) ABSTRACT

A power screwdriver and/or drill has a drive unit and an operating unit that has a first operating surface which is oriented substantially perpendicularly to an actuating direction of the first operating surface. The drive unit is at least activatable by the actuation of said first operating surface. The operating unit also has at least one second operating surface which is oriented substantially perpendicularly to the actuating direction of the first operating surface and is arranged at a distance from the first operating surface in the actuating direction, the drive unit is at least activatable by the actuation of said second operating surface.

7 Claims, 3 Drawing Sheets

POWER SCREWDRIVER AND/OR DRILL

This application claims priority under 35 U.S.C. § 119 to patent application no. DE 10 2012 220 426.1, filed on Nov. 9, 2012 in Germany, the disclosure of which is incorporated herein by reference in its entirety.

BACKGROUND

A power screwdriver and/or drill, in particular a battery-operated screwdriver, having a drive unit and an operating unit that has a first operating surface which is oriented substantially perpendicularly to an actuating direction of the first operating surface, the drive unit being at least activatable by the actuation of said first operating surface, has already been proposed.

SUMMARY

The disclosure proceeds from a power screwdriver and/or drill, in particular a battery-operated screwdriver, having a drive unit and an operating unit that has a first operating surface which is oriented substantially perpendicularly to an actuating direction of the first operating surface, the drive unit being at least activatable by the actuation of said first operating surface.

It is proposed that the operating unit has at least one second operating surface which is oriented substantially perpendicularly to the actuating direction of the first operating surface and is arranged at a distance from the first operating surface in the actuating direction, the drive unit being at least activatable by the actuation of said second operating surface. In particular, a "drive unit" should be understood as meaning a unit which is provided to drive an application tool fastening of the power screwdriver and/or drill in rotation about a rotation axis. Preferably, the drive unit comprises a motor and a transmission which is provided to reduce a rotary movement of the motor to an angular speed suitable for drilling and/or screwing. Preferably, the transmission has at least two transmission ratios that are selectable by an operator and/or advantageously a rotation direction reversing device which is actuable by the operator. An "operating unit" should be understood in particular as meaning a device which is provided to sense an actuation by an operator and to output an operating characteristic variable dependent on the actuation. Advantageously, the power screwdriver and/or drill has electronics which control and/or regulate the drive unit in a manner dependent on the operating characteristic variable. In particular, an "operating surface" should be understood as meaning a surface which is suitable for actuation by the operator in order to control the drive unit. Advantageously, the operating surface is located in a region of the power screwdriver and/or drill in which a finger, in particular an index finger, of one hand, holding the power screwdriver and/or drill, of the operator is arranged. The expression "substantially perpendicularly" should be understood in particular as meaning that an orientation of the operating surfaces deviates by less than 45 degrees, advantageously by less than 30 degrees, particularly advantageously by less than 15 degrees, from a plane defined by the actuating direction. Another surface of the operating means, said surface deviating from the plane by more than 45 degrees, advantageously by more than 30 degrees, particularly advantageously by more than 15 degrees, is thus a different surface than one of the operating surfaces. In particular, an "actuating direction" should be understood as meaning a direction in which the operating surfaces for controlling the drive unit are mounted such that they are movable. If the operating surfaces are mounted such that they are movable in a number of directions, for example are mounted such that they are pivotable, the actuating direction should be understood as meaning an average direction. Preferably, a characteristic variable sensor of the operating unit senses a movement of the operating surfaces in the actuating direction. In particular an operating characteristic variable of the characteristic variable sensor is proportional to the movement of the operating surfaces in the actuating direction. Preferably, the actuating direction is oriented in a manner substantially parallel to a rotation axis of the application tool fastening. In this context, the term "substantially" should be understood in particular as meaning that the actuating direction deviates by less than 45 degrees, advantageously less than 30 degrees, particularly advantageously less than 15 degrees, from an orientation of the rotation axis of the application tool fastening. In a preferred configuration, the actuating direction and the orientation of the rotation axis of the application tool fastening are oriented in parallel. The term "activatable" should be understood in particular as meaning that the drive unit can be set at least in operation by the operating surfaces being moved by the operator. Preferably, the operator can control a rotational speed of the drive unit by moving the operating surfaces. In particular, the expression "spaced apart" should be understood in this context as meaning that at least a distance greater than 5 mm, advantageously greater than 10 mm, particularly advantageously greater than 20 mm, is located between a plane intersecting the first operating surface and a plane intersecting the second operating surface and oriented perpendicularly to the actuating direction.

Preferably, the second actuating surface is arranged in a manner spaced apart from the first operating surface by less than 50 mm, particularly preferably less than 30 mm, in the actuating direction. As a result of the configuration according to the disclosure, the power screwdriver and/or drill can be operated comfortably by an operator having large hands and by an operator having small hands. Furthermore, the power screwdriver and/or drill can be operated comfortably when it is held in different ways.

In a further configuration, it is proposed that the operating unit has an operating element which has the first operating surface and the second operating surface, with the result that particularly easy production is possible. In particular, two characteristic variable sensors, which each separately sense a movement of the two operating surfaces, are not necessary. An "operating element" should be understood in particular as meaning an element that is movable as a whole by actuation.

Furthermore, it is proposed that the operating element is formed in one piece, with the result that low production costs can be achieved. The expression "in one piece" should be understood as meaning in particular cohesively connected, for example by a welding process and/or adhesive-bonding process etc., and/or particularly advantageously molded, such as by being produced from a casting and/or by being produced using a single-component or multi-component injection-molding method.

It is furthermore proposed that the power screwdriver and/or drill has a pistol-shaped machine housing having a main handle, with the result that a comfortable hand position is possible, in particular when a work operation requires a large force exerted by the operator. The term "pistol-shaped" should be understood in particular as meaning that the machine housing has a housing part which extends in a manner parallel to a rotation axis of the application tool fastening, and a housing part which forms the main handle and extends substantially perpendicularly to the rotation axis of the application tool fastening, that is to say in particular at an angle which deviates by less than 45 degrees from a perpendicular to the rotation axis of the application tool fastening. Preferably, the operating element is arranged in the angle enclosed by the two housing parts. In particular, a "machine housing" should be understood as meaning a component which arranges the other components of the power screwdriver and/or drill relative to one another and encloses them in a protective manner. A "main handle" should be understood in particular as meaning a region of the machine housing which is provided to be gripped by the operator during a work operation.

It is additionally proposed that at least the second operating surface is arranged at a distance of less than 70 mm from a side, remote from the main handle, of the machine housing, with the result that the power screwdriver and/or drill is gripped from the side remote from the main handle and in the process the operating element can be actuated. In particular, a "side remote from the main handle" should be understood as meaning a side of the machine housing which extends substantially in a manner parallel to the rotation axis of the application tool fastening and is located on a straight line which intersects one of the operating surfaces and the rotation axis of the application tool fastening, wherein the rotation axis is arranged on the straight line between the operating surface and the side remote from the main handle. The expression "arranged at a particular distance from" should be understood in particular as meaning that a shortest path between the side remote from the main handle and the operating surface is at least the particular distance, in particular less than 70 mm, advantageously less than 60 mm, particularly advantageously less than 50 mm.

It is furthermore proposed that the machine housing has an overall length less than 180 mm, advantageously 160 mm, particularly advantageously less than 150 mm, with the result that the power screwdriver and/or drill can be used advantageously at locations which are difficult to access. An "overall length" should be understood in particular as meaning a dimension of the machine housing parallel to the rotation axis of the application tool fastening.

In an advantageous embodiment of the disclosure, it is proposed that the machine housing has an overall height less than 200 mm, advantageously less than 150 mm, particularly advantageously less than 120 mm, with the result that the power screwdriver and/or drill can be used advantageously at locations which are difficult to access. An "overall height" should be understood in particular as meaning a dimension of the machine housing perpendicularly to the rotation axis of the application tool fastening.

In a further configuration, it is proposed that the operating unit has an operating element guide which is provided to mount the operating element such that it is pivotable about an axis which is arranged on a side, facing the drive unit, of the operating element, with the result that the operating element can be fastened stably in a structurally simple manner. In addition, actuation is particularly comfortable when the operator holds the power screwdriver and/or drill by the main handle. In particular, an "operating element guide" should be understood as meaning a device which is provided to fasten the operating element such that it is movable at least in the operating direction. Preferably, the operating element guide is formed at least partially in one piece with the machine housing. The term "provided" should be understood in particular as meaning specially programmed, configured and/or equipped. In particular, "mounted such that it is pivotable" should be understood as meaning that the operating element guide fastens the operating element such that it is rotatable about an axis. Preferably, the operating element guide has an in particular rod-like pivot axis. The expression "on a side facing the drive unit" should be understood in particular as meaning that the axis is arranged closer to the drive unit than to a central point of the operating element.

It is furthermore proposed that the operating unit has an operating element guide which is provided to mount the operating element such that it is pivotable about an axis which is arranged on a side, remote from the drive unit, of the operating element, with the result that it is possible to stably fasten the operating element in a structurally simple manner. In addition, actuation is particularly convenient if the operator grips the power screwdriver and/or drill from the side remote from the main handle. The expression "on a side remote from the drive unit" should be understood in particular as meaning that the axis is arranged further away from the drive unit than from a central point of the operating element.

It is furthermore proposed that the operating unit has an operating element guide which is provided to guide the operating element such that it is movable in translation, with the result that it is possible to sense the actuation in a structurally simple manner. The expression "in translation" should be understood in particular as meaning that all points of the operating element are moved in one and the same direction upon actuation.

Furthermore, it is proposed that the operating unit has an operating element guide which is provided to guide the operating element in a floating manner, with the result that advantageous actuation is possible in different hand positions. The term "floating" should be understood in particular as meaning that the operating element can be actuated so as to be moved in translation and to be moved in a pivoted manner.

The power screwdriver and/or drill according to the disclosure is not intended to be restricted to the above-described application and embodiment. In particular, the power screwdriver and/or drill according to the disclosure can have a different number of individual elements, components and units than the number mentioned herein in order to fulfill a mode of operation described herein.

BRIEF DESCRIPTION OF THE DRAWINGS

Further advantages can be gathered from the following description of the drawing. In the drawing, four exemplary embodiments of the disclosure are illustrated. The drawing, the description and the claims contain numerous features in combination.

A person skilled in the art will also expediently view the features individually and combine them to form meaningful further combinations.

In the drawing:

Figure 1:
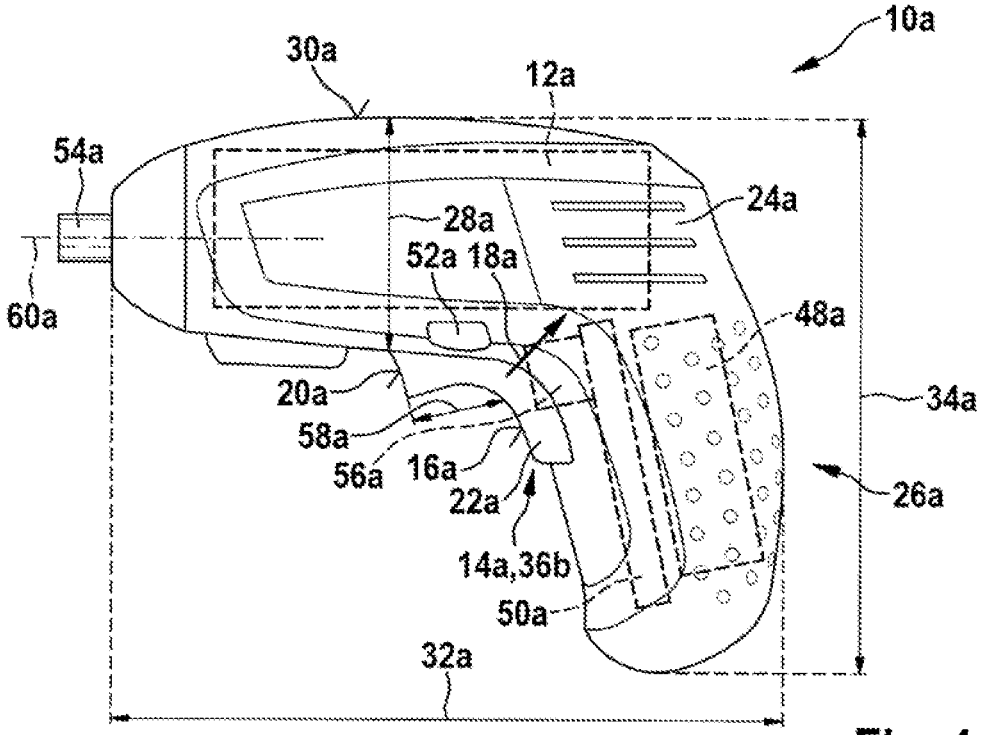
Figure 2:
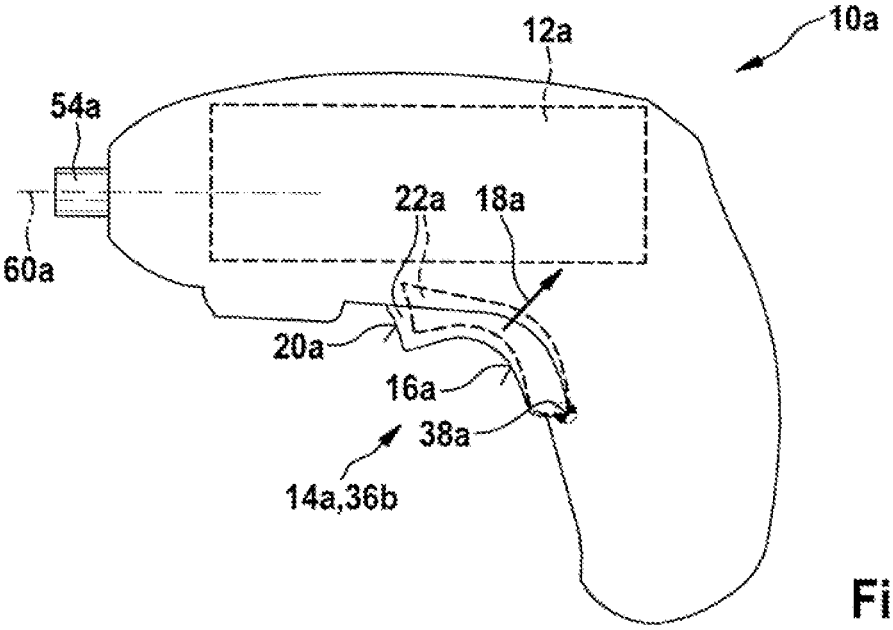
Figure 3:
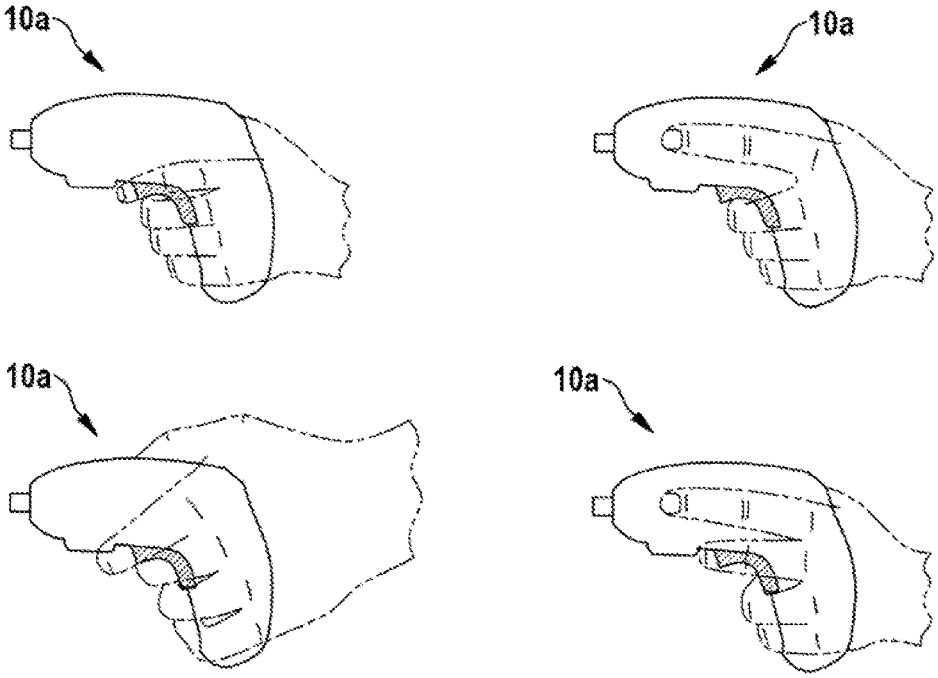
Figure 4:
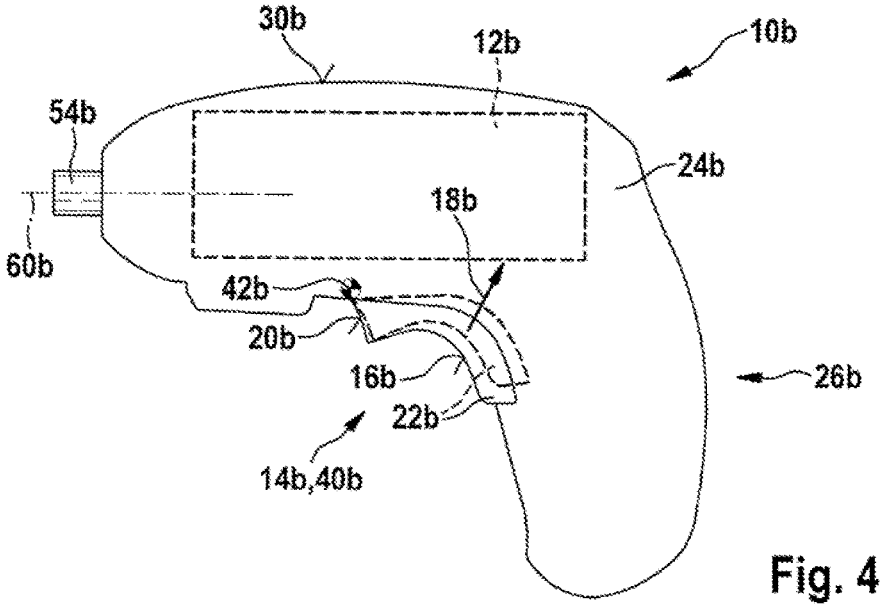
Figure 5:
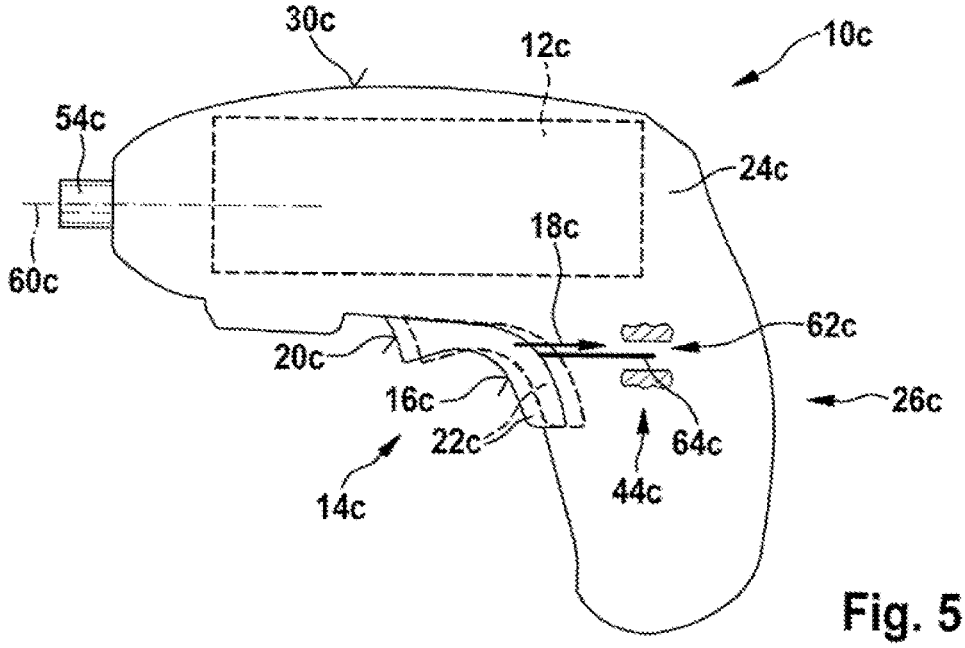
Figure 6:
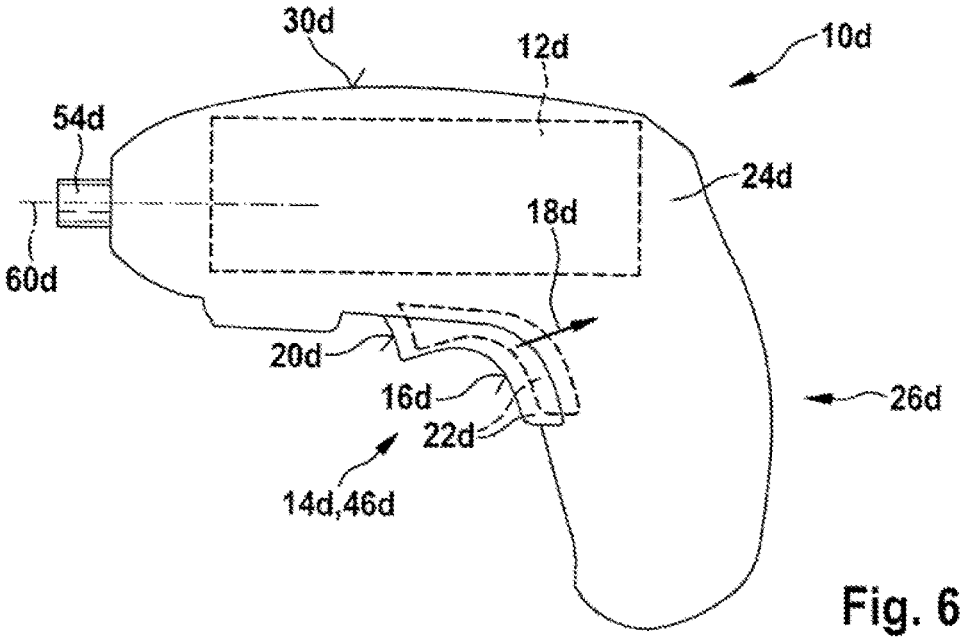

FIG. 1 shows a side view of a power screwdriver and/or drill according to the disclosure having a drive unit and an operating element which is mounted on a side, facing the drive unit, of the operating element, FIG. 2 shows a schematic section through the power screwdriver and/or drill from FIG. 1, FIG. 3 shows the power screwdriver and/or drill from FIG. 1 with different advantageous hand positions of a hand of an operator, FIG. 4 shows a schematic section through an alternative exemplary embodiment of the power screwdriver and/or drill from FIG. 1 having a drive unit and an operating element which is mounted on a side, remote from the drive unit, of the operating element, FIG. 5 shows a schematic section through an alternative exemplary embodiment of the power screwdriver and/or drill from FIG. 1 having an operating element which is mounted such that it is movable in translation, and FIG. 6 shows a schematic section through an alternative exemplary embodiment of the power screwdriver and/or drill from FIG. 1 having an operating element which is mounted so as to be movable in a floating manner.

DETAILED DESCRIPTION

FIGS. 1 and 2 show a power screwdriver and/or drill 10*a* which is in the form of a battery-operated screwdriver. The power screwdriver and/or drill 10*a* has a drive unit 12*a*, an operating unit 14*a*, a pistol-shaped machine housing 24*a*, a rechargeable battery 48*a*, electronics 50*a*, a rotation direction selector 52*a* and an application tool fastening 54*a*. The application tool fastening 54*a* is provided to fasten a hexagonal bit. By means of the rotation direction selector 52*a*, a rotation direction reversing device (not illustrated in more detail) of the drive unit 12*a* is actuable, with the result that an operator can switch between clockwise and counterclockwise rotation of the application tool fastening 54*a*. The electronics 50*a* are provided to supply the drive unit 12*a* with electrical energy from the rechargeable battery 48*a* in a manner dependent on an operator input by means of the operating unit 14*a*.

The operating unit 14*a* has an operating element 22*a*, an operating element guide 36*a* and a characteristic variable sensor 56*a*. Upon actuation, the characteristic variable sensor 56*a* senses a movement of the operating element 22*a* and outputs an operating characteristic variable dependent on the actuation. The electronics 50*a* sense the operating characteristic variable and activate, control and/or regulate the drive unit 12*a*.

The operating element 22*a* is formed in one piece. The operating element 22*a* has a first operating surface 16*a* and a second operating surface 20*a*. The operating surfaces 16*a*, 20*a* are oriented substantially perpendicularly to an actuating direction 18*a* of the operating element 22*a*. In this case, the operating surfaces 16*a*, 20*a* are formed in a slightly curved manner and form an angle of between 15 degrees and 25 degrees with respect to a plane defined by the actuating direction 18*a*. The second operating surface 20*a* is arranged at a distance from the first operating surface 16*a* in the actuating direction 18*a*. In this case, the smallest distance 58*a* is approximately 22 mm.

The second operating surface 20*a* is arranged at a distance 28*a* of less than 70 mm, in this case 55 mm, from a side 30*a*, remote from the main handle 26*a*, of the machine housing 24*a*. The machine housing 24*a* has an overall length 32*a* less than 180 mm, in this case 140 mm. The machine housing 24*a* has an overall height 34*a* less than 200 mm, in this case 105 mm. As illustrated in FIG. 3, the machine housing 24*a* can be gripped in different ways during a work operation, and at least one of the two operating surfaces 16*a*, 20*a* can nevertheless be reached comfortably by a finger.

The operating element guide 36*a* is provided to mount the operating element 22*a* such that it is pivotable about an axis 38*a* which is arranged on a side, facing the drive unit 12*a*, of the operating element 22*a*. To this end, the operating element guide 36*a* has (not illustrated in more detail here) a pivot axis, guide surfaces and stops. The pivot axis is oriented perpendicularly to a rotation axis 60*a* of the application tool fastening 54*a*. The guide surfaces laterally guide the operating element 22*a*. The stops limit a pivoting range of the operating elements 22*a*. In FIG. 1, the operating element 22*a* is illustrated by dashed lines in a position in which the stops limit a movement of the operating element upon actuation.

FIGS. 4 to 6 show three further exemplary embodiments of the disclosure. The following descriptions and the drawing are limited substantially to the differences between the exemplary embodiments, and reference can be made, with regard to identically designated components, in particular with regard to components having identical reference signs, in principle also to the drawings and/or the description of the other exemplary embodiments, in particular of FIGS. 1 to 3. In order to distinguish between the exemplary embodiments, the letter a is added after the reference signs of the exemplary embodiment in FIGS. 1 to 3. The letter a has been replaced by the letters b to d in the exemplary embodiments in FIGS. 4 to 6.

FIG. 4 shows a power screwdriver and/or drill 10*b* in the form of a battery-operated screwdriver. The power screwdriver and/or drill 10*b* comprises at least one drive unit 12*b*, an operating unit 14*b* and an application tool fastening 54*b*. The operating unit 14*b* comprises an operating element 22*b* and an operating element guide 40*b*. The operating element 22*b* has a first operating surface 16*b* and a second operating surface 20*b*. By actuating one of the operating surfaces 16*b*, 20*b* in an actuating direction 18*b*, the drive unit 12*b* is activatable. The operating surfaces 16*b*, 20*b* are oriented substantially perpendicularly to the actuating direction 18*b*. The first operating surface 16*b* is arranged at a distance from the second operating surface 20*b* in the actuating direction 18*b*.

The operating element guide 40*b* is provided to mount the operating element 22*b* such that it is pivotable about an axis 42*b* which is arranged on a side, facing away from the drive unit 12*b* of the operating element 22*b*. To this end, the operating element guide 40*b* has (not illustrated in more detail here) a pivot axis, guide surfaces and stops. The pivot axis is oriented perpendicularly to a rotation axis 60*b* of the application tool fastening 54*b*.

FIG. 5 shows a power screwdriver and/or drill 10*c* in the form of a battery-operated screwdriver. The power screwdriver and/or drill 10*c* comprises a drive unit 12*c*, an operating unit 14*c* and an application tool fastening 54*c*. The operating unit 14*c* comprises an operating element 22*c* and an operating element guide 44*c*. The operating element 22*c* has a first operating surface 16*c* and a second operating surface 20*c*. By actuating one of the operating surfaces 16*c*, 20*c* in an actuating direction 18*c*, the drive unit 12*c* is activatable. The operating surfaces 16*c*, 20*c* are oriented substantially perpendicularly to the actuating direction 18*c*. The first operating surface 16*c* is arranged at a distance from the second operating surface 20*c* in the actuating direction 18*c*.

The operating element guide 44*c* is provided to mount the operating element 22*c* such that it is movable in translation. To this end, the operating element guide 44*c* has at least one schematically illustrated guide groove 62*c* in which at least one sliding block 64*c* runs. The guide groove 62*c* extends in a manner parallel to a rotation axis 60*c* of the application tool fastening 54*e*. The guide groove 62*c* comprises stops (not illustrated in more detail) which limit a movement range of the operating elements 22*c*.

FIG. 5 shows a power screwdriver and/or drill 10*d* in the form of a battery-operated screwdriver. The power screwdriver and/or drill 10*d* comprises a drive unit 12*d*, an operating unit 14*d* and an application tool fastening 54*d*. The operating unit 14*d* comprises an operating element 22*d* and an operating element guide 46*d*. The operating element 22*d* has a first operating surface 16*d* and a second operating surface 20*d*. By actuating one of the operating surfaces 16*d*, 20*d* in an actuating direction 18*d*, the drive unit 12*d* is activatable. The operating surfaces 16*d*, 20*d* are oriented substantially perpendicularly to the actuating direction 18*d*. The first operating surface 16*d* is arranged at a distance from the second operating surface 20*d* in the actuating direction 18*d*.

The operating element guide 46*d* is provided to guide the operating element 22*d* in a floating manner. To this end, the operating element guide 46*d* fastens the operating element 22*d* such that it is pivotable and movable in translation. In this case, the operating element 22*d* has a clearance, in this case about 2 mm, perpendicularly to the average actuating direction 18*d*.

What is claimed is:

1. A power tool configured as at least one of a screwdriver and a drill, comprising: a drive unit; an operating unit that defines: a first operating surface portion oriented substantially perpendicularly to an actuating direction; a second operating surface portion oriented substantially parallel to the first operating portion; and a middle portion extending between the first operating surface portion and the second operating surface portion and oriented so as to be not substantially perpendicular to the actuating direction such that the second operating surface portion is spaced apart from the first operating surface portion along the actuating direction; the drive unit configured to be activated by actuation of the first operating surface portion along the actuating direction; and the drive unit further configured to be activated by actuation of the second operating surface portion along the actuating direction; and a pistol-shaped machine housing having a main handle, wherein at least one of: at least the second operating surface portion is arranged at a distance of less than 70 mm from a side, remote from the main handle, of the machine housing; the machine housing has an overall length less than 180 mm; and the machine housing has an overall height less than 200 mm.

2. The power tool of claim 1, wherein:

the operating unit includes an operating element formed in one piece; and the first operating surface portion, the second operating surface portion, and the middle portion are defined by the operating element.

3. The power screwdriver and/or drill according to claim 2, wherein the operating unit further includes an operating element guide configured to at least one of:

mount the operating element such that the operating element is pivotable about an axis arranged on a side, facing the drive unit, of the operating element;

guide the operating element such that the operating element is movable in translation; and guide the operating element in a floating manner.

4. The power tool of claim 1, wherein the power tool is a battery operated screwdriver.

5. The power tool of claim 2, wherein a surface of the middle portion of the operating element facing away from the power tool has a concave shape.

6. The power tool of claim 1, wherein an extent of the first operating surface portion substantially perpendicular to the actuating direction is substantially equal to an extent of the second operating surface portion substantially perpendicular to the actuating direction.

7. The power tool of claim 6, wherein a length of a surface of the middle portion extending from the first operating surface portion to the second operating surface portion is larger than the extent of the first operating surface portion substantially perpendicular to the actuating direction.

* * * * *